US012084964B2

(12) United States Patent
Werkheiser et al.

(10) Patent No.: US 12,084,964 B2
(45) Date of Patent: Sep. 10, 2024

(54) ACOUSTIC CHANNEL IDENTIFICATION IN WELLBORE COMMUNICATION DEVICES

(71) Applicant: Halliburton Energy Services, Inc., Houston, TX (US)

(72) Inventors: Gregory Thomas Werkheiser, Carrollton, TX (US); Zeke Shashoua, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 273 days.

(21) Appl. No.: 17/603,435

(22) PCT Filed: Jun. 14, 2019

(86) PCT No.: PCT/US2019/037224
§ 371 (c)(1),
(2) Date: Oct. 13, 2021

(87) PCT Pub. No.: WO2020/251586
PCT Pub. Date: Dec. 17, 2020

(65) Prior Publication Data

US 2022/0186613 A1 Jun. 16, 2022

(51) Int. Cl.
*E21B 47/14* (2006.01)

(52) U.S. Cl.
CPC ..... *E21B 47/14* (2013.01)

(58) Field of Classification Search
None
See application file for complete search history.

(56) References Cited

U.S. PATENT DOCUMENTS 4,739,325 A 4/1988 Macleod
5,050,132 A * 9/1991 Duckworth ..... E21B 47/16 367/82

(Continued)

FOREIGN PATENT DOCUMENTS

WO 2009143409 11/2009

OTHER PUBLICATIONS

International Application No. PCT/US2019/037224, International Search Report and Written Opinion, mailed on Mar. 13, 2020, 12 pages.

*Primary Examiner* — Isam A Alsomiri
*Assistant Examiner* — Jonathan D Armstrong
(74) *Attorney, Agent, or Firm* — Kilpatrick Townsend & Stockton LLP

(57) ABSTRACT

A system includes a tubing positionable within a wellbore and a first downhole communication device positionable to receive acoustic signals from the tubing and to transmit acoustic signals to the tubing. The system also includes a computing device in communication with the first downhole communication device and including a processor and a non-transitory computer-readable medium that includes instructions that are executable by the processor to perform operations. The operations include receiving a test message including a spectral waveform from a second downhole communication device. The operations further include determining a desired reception frequency for receiving communications from the second downhole communication device using spectral data generated from the spectral waveform. Additionally, the operations include controlling the first downhole communication device to transmit a response message to the second downhole communication device identifying the desired reception frequency.

20 Claims, 6 Drawing Sheets

(56) References Cited

U.S. PATENT DOCUMENTS 5,307,284 A 4/1994 Brunfeldt et al.
6,816,082 B1 11/2004 Laborde
7,042,367 B2 * 5/2006 Gardner ..... G01V 11/00 340/853.3
7,443,312 B2 * 10/2008 Quintero ..... E21B 47/12 340/855.8
7,548,068 B2 6/2009 Rawle et al.
9,670,773 B2 6/2017 Croux
9,963,965 B2 * 5/2018 Saed ..... H04L 27/2626
10,294,780 B2 * 5/2019 Barak ..... E21B 47/18
11,248,461 B2 * 2/2022 Vehra ..... E21B 47/13
2002/0140572 A1 * 10/2002 Gardner ..... E21B 47/12 166/241.5
2003/0142586 A1 7/2003 Shah et al.
2005/0104743 A1 * 5/2005 Ripolone ..... G01V 11/002 340/855.1
2005/0270171 A1 * 12/2005 Quintero ..... G01V 11/002 340/853.1
2006/0055556 A1 * 3/2006 Memarzadeh ..... E21B 47/14 340/870.07
2007/0189119 A1 * 8/2007 Klotz ..... E21B 47/18 367/83
2009/0180524 A1 * 7/2009 Wang ..... H04B 1/7085 375/E1.002
2012/0250461 A1 10/2012 Millot et al.
2012/0307839 A1 * 12/2012 Ionescu ..... A61N 1/3956 370/431
2015/0292319 A1 10/2015 Disko et al.
2016/0047236 A1 * 2/2016 Croux ..... E21B 47/16 367/82
2016/0201455 A1 7/2016 Liu et al.
2017/0138184 A1 * 5/2017 Saed ..... H04L 27/2626
2017/0138185 A1 * 5/2017 Saed ..... E21B 47/16
2018/0058205 A1 3/2018 Clawson et al.
2018/0245461 A1 * 8/2018 Barak ..... G01V 11/002
2019/0007159 A1 * 1/2019 Dufour ..... E21B 47/12
2021/0231005 A1 * 7/2021 Vehra ..... H04L 12/40182
2022/0251949 A1 * 8/2022 Maclean ..... H04L 27/103

* cited by examiner

ACOUSTIC CHANNEL IDENTIFICATION IN WELLBORE COMMUNICATION DEVICES

TECHNICAL FIELD

The present disclosure relates generally to downhole communication in well systems. More specifically, but not by way of limitation, this disclosure relates to control of acoustic channels used for communication between communication devices deployed within a wellbore.

BACKGROUND

A well system (e.g., an oil or gas well system) may include a wellbore drilled through a subterranean formation. The subterranean formation may include a rock matrix permeated by oil or gas that is to be extracted using the well system. Downhole communication within the wellbore may depend on acoustic signals transmitted along sections of downhole tubing. Changes to the environment surrounding downhole communication devices may result in a loss of communication across the sections of downhole tubing due to a shift of available communication frequencies for an acoustic signal.

To compensate for changes to the environment surrounding the downhole communication devices, a communication system relies on a time consuming process of individually testing frequencies within a range of available frequencies. Once the range of available frequencies have been tested, an operator of the communication system selects a new frequency channel with a strongest frequency between the communication devices, as identified from the range of individually tested frequencies. Sending the test messages across the available frequency range is a time intensive process both based on the transmission of the test messages and a user's analysis to identify a new transmission frequency.

DETAILED DESCRIPTION

Certain aspects and features of the present disclosure relate to controlling acoustic channels used for communication between communication devices (e.g., receivers, transmitters, or transceivers) deployed within a wellbore. The communication devices deployed within a wellbore may communicate most efficiently along certain acoustic channels due to effects of wellbore conditions surrounding the communication devices on acoustic signals transmitted and received by the communication devices. When conditions within the wellbore change, the previously optimal acoustic channel may no longer provide efficient communications between the communication devices. To alleviate the reduction in efficient communications, the acoustic channels may be adjusted when a communications systems stops receiving messages from one or more communication devices within the wellbore.

The disclosed method and system offer techniques for efficiently determining acoustic channels that enable efficient communication between two communication devices. The method and system involve accelerating identification of usable acoustic frequencies between two communication devices. As discussed in detail below with respect to the figures, the acoustic channels may be identified by appending a spectral waveform to a test message that is transmitted from one communication device to a receiving communication device within a wellbore. Spectrum data received at the receiving communication device may identify frequency bands at which communication between the communication devices is most efficient. This spectrum data can be used by the communication devices to establish an acoustic channel for communication.

Illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
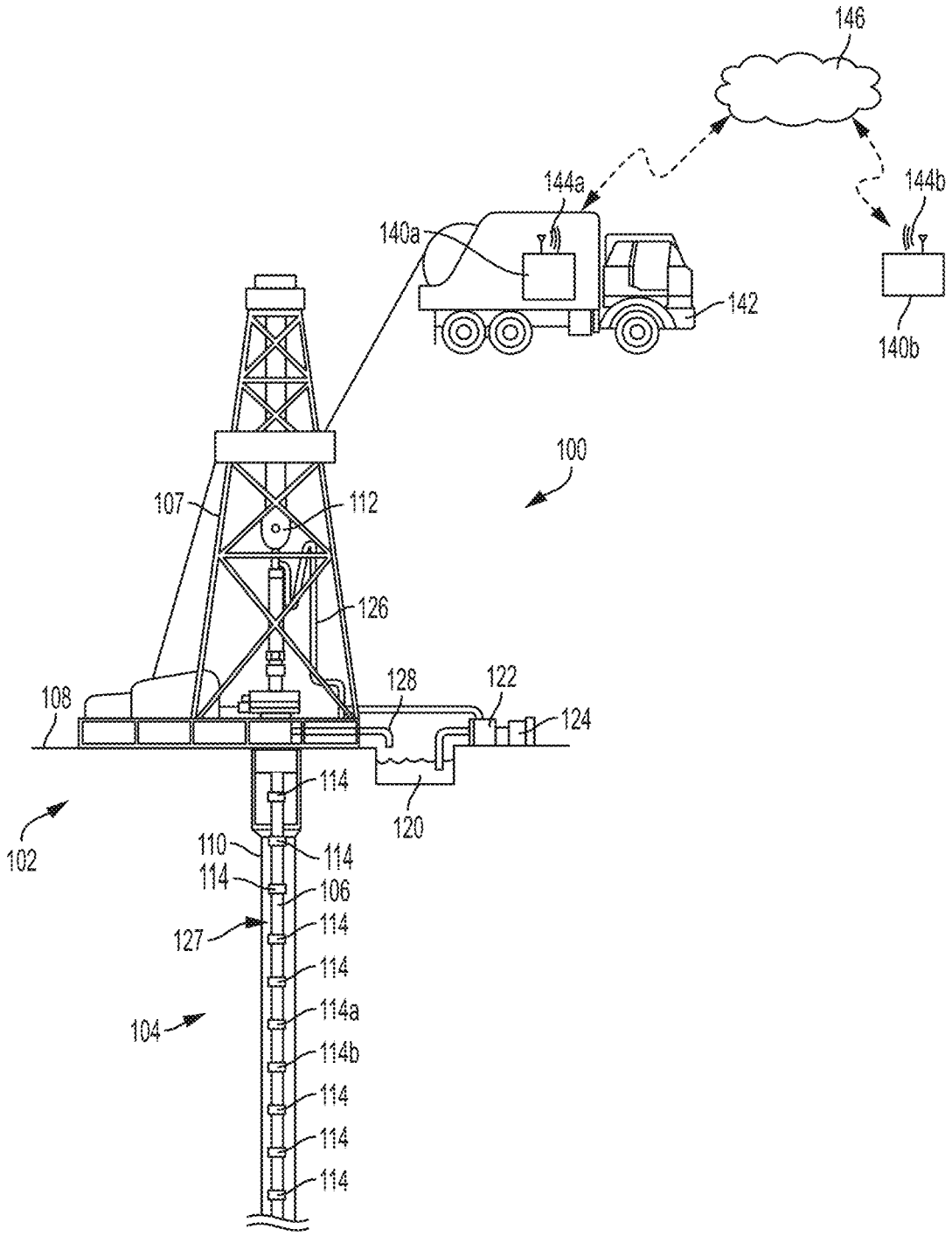
FIG. 1 is a schematic view of an example of a well system according to some aspects.

FIG. 1 is a cross-sectional view of an example of a well system 100 that may employ one or more principles of the present disclosure. A wellbore may be created by drilling into the formation 102 using the well system 100. The well system 100 may deploy one or more downhole tools (not shown) positioned or otherwise arranged along tubing 106 extending into the formation 102 from a derrick 107 arranged at a surface 108 of the well system 100. The tubing 106 may include production tubing, a drill string, coiled tubing, or any other tubing capable of providing an acoustic path within a wellbore 110. The derrick 107 may include a kelly 112 used to lower and raise the tubing 106. Multiple communication devices 114 may be positioned along a length of the tubing 106 at regular or irregular intervals.

The communication devices 114 may be receivers, transmitters, transceivers, or a combination thereof. In an example, the communication devices 114 may transmit acoustic signals along the tubing 106 and receive acoustic signals from other communication devices 114 from the tubing 106 to communicate information uphole to the surface 108 or downhole to downhole tools communicatively coupled to the communication devices 114. In an example, the downhole tools may include pressure sensors, temperature sensors, valve control devices, samplers, perforating guns, or any other tools positionable within the wellbore 110 and capable of communicating with the communication devices 114.

The communication devices 114 may transmit acoustic signals along the tubing 106. In an example, an acoustic channel (i.e., a frequency) of the acoustic signals may be selected based on conditions within the wellbore 110. For example, temperature, pressure, wellbore fluid flow, etc. may all affect acoustic transmissions along the tubing 106.

In some examples, the changes to the wellbore conditions may result in acoustic transmissions no longer being received by one or more of the communication devices 114. In such an example, the acoustic channel for the transmitted signal may be adjusted, as described herein, such that the communication devices 114 may again effectively transmit the acoustic signals along the tubing 106. While the communication devices 114 are generally described herein as acoustic telemetry devices, the communication devices 114 may also include devices using any other telemetry method in which a frequency is not fixed. For example, the communication devices 114 may also use electromagnetic (EM) telemetry methods or mudpulse telemetry methods.

During a drilling operation, the downhole tools communicatively coupled to the communication devices 114 may be logging-while-drilling (LWD) or measuring-while-drilling (MWD) tools. Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into a mud bore (not shown) within the tubing 106 and conveys the same to a drill bit located at a downhole end of the wellbore 110. The mud may exit the drill bit and in the process cool and lubricate the drill bit. After exiting the drill bit, the mud circulates back to the surface 108 via an annulus 127 defined between the wellbore 110 and the tubing 106. In the process of circulating to the surface 108, the mud may return drill cuttings and debris from the wellbore 110 to the surface 108. The cuttings and mud mixture are passed through line 128 and are processed such that a cleaned mud may be returned downhole through the stand pipe 126.

Still referring to FIG. 1, the downhole tools may be in communication with a computing device 140*a*, which is illustrated by way of example at the surface 108 in FIG. 1, using the communication devices 114. In an additional embodiment, the computing device 140*a* may be located elsewhere, such as downhole, or the computing device may be a distributed computing system including multiple, spatially separated computing components (e.g., 140*a*, 140*b*, downhole, or any combination thereof). Other equipment of the well system 100 described herein may also be in communication with the computing device 140*a*. In some embodiments, one or more processors used to control a drilling operation of the well system 100 or a logging operation of the well system 100 may be in communication with the computing device 140*a*.

In FIG. 1, the computing device 140*a* is illustrated as being deployed in a work vehicle 142. However, the computing device 140*a* that receives data from the downhole tools in communication with the communication devices 114 may be permanently installed surface equipment of the well system 100. In other embodiments, the computing device 140*a* may be hand-held or remotely located from the well system 100. In some examples, the computing device 140*a* may process at least a portion of the data received and transmit the processed or unprocessed data to an additional computing device 140*b* via a wired or wireless network 146. The additional computing device 140*b* may be offsite, such as at a data-processing center. The additional computing device 140*b* may receive the data, execute computer program instructions to issue commands to control the operation of the well system 100, and communicate those commands to computing device 140*a*.

The computing devices 140*a-b* may be positioned below-ground, aboveground, onsite, in a vehicle, offsite, etc. The computing devices 140*a-b* may include a processor interfaced with other hardware via a bus. A memory, which may include any suitable tangible (and non-transitory) computer-readable medium, such as RAM, ROM, EEPROM, or the like, can embody program components that configure operation of the computing devices 140*a-b*. In some aspects, the computing devices 140*a-b* may include input/output interface components (e.g., a display, printer, keyboard, touch-sensitive surface, and mouse) and additional storage.

The computing devices 140*a-b* may include surface communication devices 144*a-b*. The surface communication devices 144*a-b* may represent one or more of any components that facilitate a network connection. In the example shown in FIG. 1, the surface communication devices 144*a-b* are wireless and may include wireless interfaces such as IEEE 802.11, Bluetooth, or radio interfaces for accessing cellular telephone networks (e.g., RF stage/antenna for accessing a CDMA, GSM, UMTS, or other mobile communications network). In some examples, the surface communication devices 144*a-b* may use acoustic waves, surface waves, vibrations, optical waves, or induction (e.g., magnetic induction) for engaging in wireless communications. In other examples, the surface communication devices 144*a-b* may be wired and can include interfaces such as Ethernet, USB, IEEE 1394, or a fiber optic interface. The computing devices 140*a-b* can receive wired or wireless communications from one another and perform one or more tasks based on the communications.

While FIG. 1 depicts the well system 100 where the computing devices 140*a-b* receive data from the downhole tools in communication with the communication devices 114 for use in controlling equipment of the well system 100, control of other systems using the computing devices 140*a-b* is also contemplated. For example, the computing devices 140*a-b* may receive performance data related to hydrocarbon production systems, wellbore casing and cementing systems, wellbore fracturing systems, wellbore maintenance programs, or any other wellbore technologies. The computing devices 140*a-b* may receive the performance data, execute computer program instructions to issue commands to control the operation of the wellbore technology, and apply those commands to equipment of the wellbore technology (e.g., using the communication devices 114). In some aspects, the performance data may be considered "real-time" data as the performance data is collected and transmitted to the computing devices 140*a-b* as the wellbore equipment is operated.

In an example, the computing devices 140*a-b* may issue commands to the downhole tools in communication with the communication devices 114 by providing instructions to a furthest uphole communication device 114 using an acoustic signal applied to a portion of the tubing 106 extending out of the wellbore 110. In such an example, the communication devices 114 operate as repeaters by receiving the acoustic signal and repeating the acoustic signal onto the tubing 106 for the next communication device 114 to receive. The communication devices 114 may transmit the acoustic signals on varying acoustic channels based on the downhole conditions (e.g., temperature, pressure, wellbore fluid flow, etc.) at the communication devices 114.

When downhole conditions change within the wellbore 110 at one or more of the communication devices 114, communication between the communication devices 114 may be compromised on a current acoustic channel used to transmit messages. When the computing device 140*a-b*, or a user operating the computing device 140*a-b*, determines that acoustic signal transmission is stopping along the tubing 106 at one of the communication devices 114, the computing devices 140*a-b* may initiate a transmission frequency change at an affected communication device 114 using a communication frequency selection process discussed herein. In an example, the communication frequency selection process may instruct an uphole communication device 114 (e.g., the communication device 114*a*) to transmit a test message to the affected communication device 114 (e.g., the downhole communication device 114*b*) at varying frequencies until the test message is received by the affected communication device 114. Because the test message includes a spectral waveform appended to the test message, the affected communication device 114 is able to identify frequency bands from the spectral waveform that provide a highest quality signal for receipt at the affected communication device 114. A similar process may be repeated from the affected communication device 114 to the uphole communication device 114 to identify a highest quality signal for receipt at the uphole communication device 114. Based on the identified frequency bands, the uphole communication device 114 and the affected communication device 114 may change frequency channels used for communication between the two communication devices 114, as discussed in detail below with respect to FIGS. 2-5.

Figure 2:
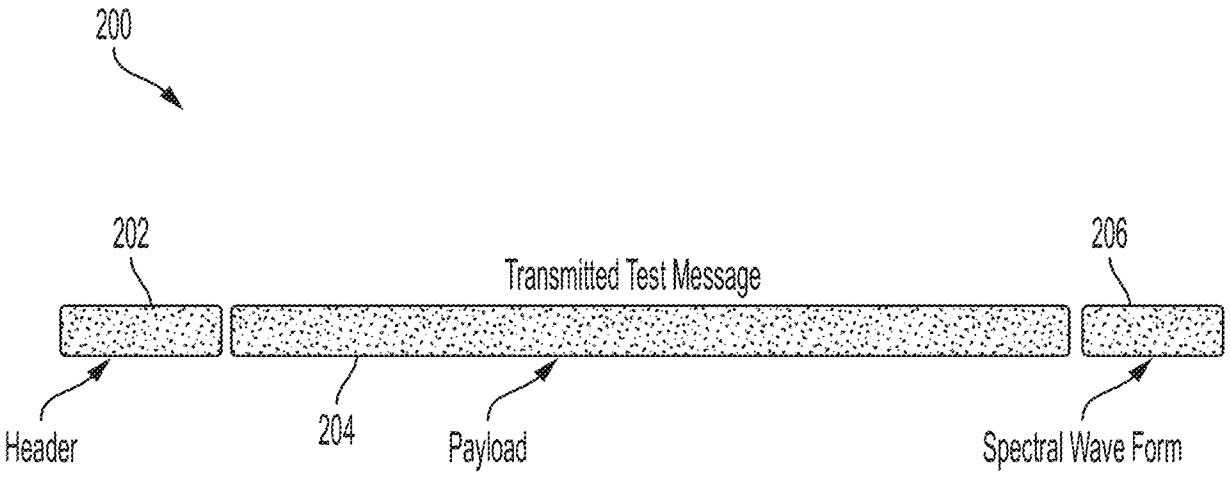
FIG. 2 is an example of a test message transmitted between communication devices within the well system of FIG. 1 according to some aspects.

FIG. 2 is an example of a test message 200 transmitted between the communication devices 114 within the well system 100. As discussed above with respect to FIG. 1, when the computing device 140*a-b*, or a user of the computing device 140*a-b*, determines that one or more of the communication devices 140 are no longer transmitting or receiving messages, the computing device 140*a-b* may begin the a communication frequency selection process. For example, the computing device 140*a-b* may transmit a message downhole along the tubing 106 to instruct an uphole communication device 114 (e.g., the communication device 114*a*) to transmit the test message 200 to the affected communication device 114 (e.g., the downhole communication device 114*b*). The test message 200 may be repeated at a number frequencies within a selected frequency range until the uphole communication device 114 receives an indication from the affected communication device 114 that the test message 200 was received.

In the illustrated example, the test message 200 may include a header 202, a payload 204, and a spectral waveform 206. In an example, the header 202 may provide an indication that the test message 200 is a test message. The payload 204 may include the body of the test message 200. In an example, the payload 204 may provide an indication of a frequency on which the test message 200 is transmitted, or the payload 204 may include any additional information relevant to the communication frequency selection process. For example, the test message 200 may include a standard communication message sent between the communication devices 114 (e.g., before a disruption in communication is detected). In such an example, the payload 204 includes the message contents, and the receiving communication device 114 can determine if a better frequency is available for communication based on analysis of the spectral waveform 206. Further, the receiving communication device 114 is able to initiate a change in the communication frequency, as described herein, based on the analysis of the spectral waveform 206 included with the standard communication message. In other examples, the payload 204 may not contain any useful information, or the payload 204 may be removed altogether from the test message 200.

In one or more examples, the spectral waveform 206 is appended to the payload 204 (or the header 202 when the payload 204 is not present) of the test message 200. The spectral waveform 206 may be a flat spectrum signal in the frequency domain that spans a range of frequencies. For example, the flat spectrum signal may span a range of frequencies from 2 kHz to 3 kHz. Other frequency ranges may also be transmitted in the spectral waveform 206. The flat spectrum signal of the spectral waveform 206 indicates that the frequencies within the range of the spectral waveform 206 are all transmitted at an equal or approximately equal magnitude (e.g., magnitudes within 10% of each other).

Figure 3:
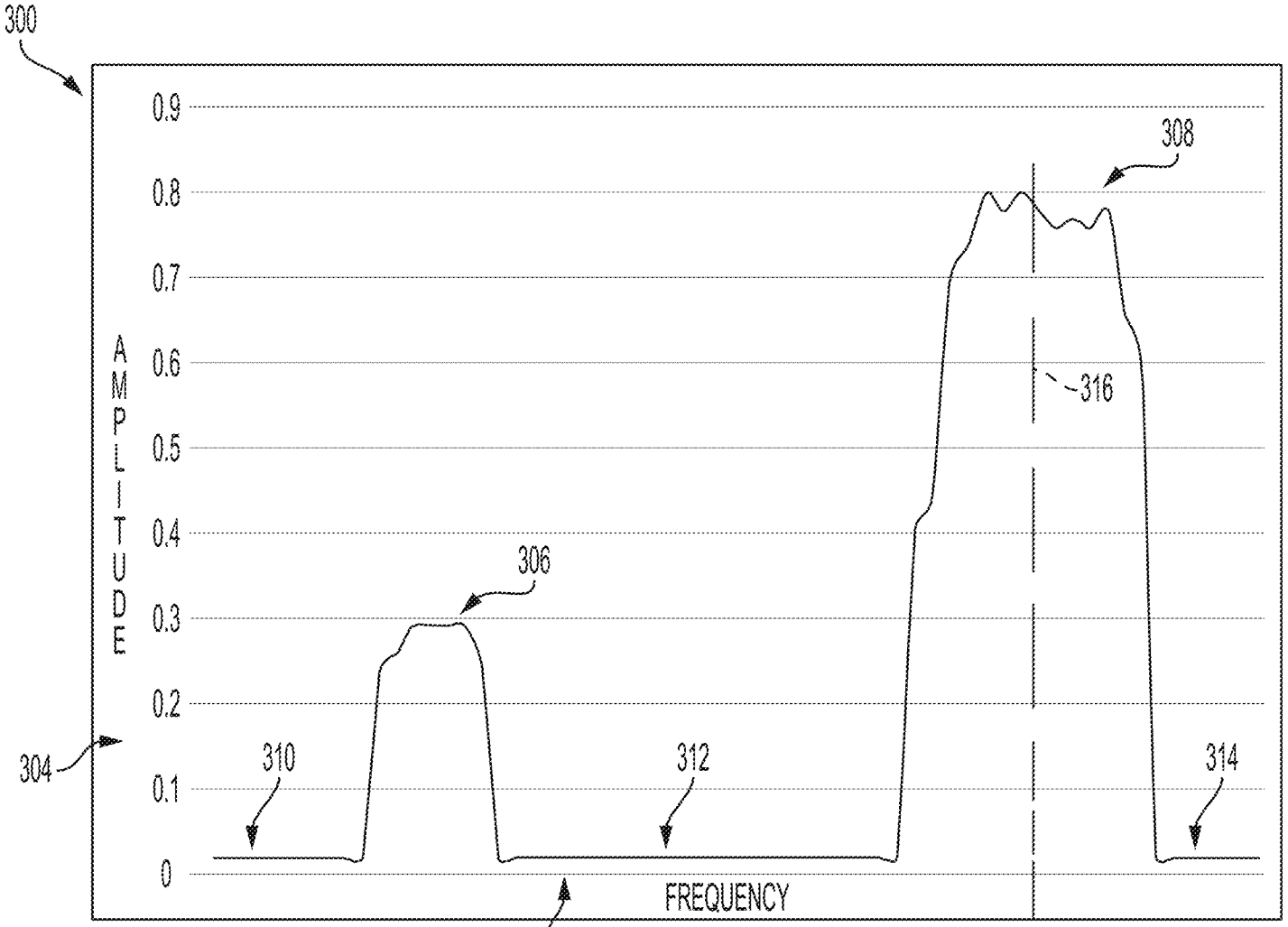
FIG. 3 is an example of a graph of spectrum data received at a downhole communication device according to some aspects.

FIG. 3 is an example of a graph 300 of spectrum data received at the downhole communication device 114*b*. An abscissa 302 represents a frequency range of the graph 300, and an ordinate 304 represents an amplitude of the received spectrum data from the spectral waveform 206. In an example, the downhole communication device 114*b* may receive the spectral waveform 206 from the uphole communication device 114*a* when the computing device 140*a-b* determines that messages are not being received at the computing device 140*a-b* from the downhole communication device 114*b*. The graph 300 depicts bands 306 and 308 (e.g., pass bands) of the spectral waveform 206 that were received by the downhole communication device 114*b*. The graph 300 also depicts an amplitude of the spectral waveform 206 received at the bands 306 and 308.

As illustrated, the downhole communication device 114*b* receives the spectral waveform 206 at bands 306 and 308, but the received spectrum data outside of the bands 306 and 308 approaches an amplitude of zero. The bands 306 and 308 that enable receipt of the spectral waveform 206 may be a result of the wellbore conditions surrounding the downhole communication device 114*b*, the uphole communication device 114*a*, or a combination thereof. For example, the wellbore conditions may provide conditions that only pass certain signal frequency bands (e.g., the bands 306 and 308) of signals while damping any remaining frequency bands (e.g., bands 310, 312, and 314).

A processor that is connected to or otherwise in communication with the downhole communication device 114*b* may analyze the received spectrum data, as depicted in the graph 300, to determine an optimal acoustic channel for the uphole communication device 114*a* to transmit communication signals to the downhole communication device 114*b*. For example, while the downhole communication device 114*b* would receive signals at the frequencies represented by each of the bands 306 and 308, the greater amplitude of the band 308 may represent improved signal quality in comparison to the band 306. Further, the processor may select a frequency 316 at a midpoint of the band 308 to ensure that the signals transmitted from the uphole communication device 114*a* will have a frequency that falls within the band 308. In some examples, selection of the frequency 316 may also be associated with a frequency within a pass band with a greatest amplitude. For example, the amplitude of a pass band may be tiered with portions having a smaller amplitude than other portions. In such an example, the processor may select a frequency value at a midpoint of the tier in the pass band with the greatest amplitude. Any other techniques for selecting a suitable frequency within the pass band may also be used by the processor.

Further, the graph 300 depicts two pass bands 306 and 308 across which communication is possible from the uphole communication device 114*a* to the downhole communication device 114*b*. In one or more embodiments, the downhole communication device 114*b* may provide an indication to the uphole communication device 114*a* of the availability of both of the pass bands 306 and 308, and the uphole communication device 114*a* may use frequencies from both of the pass bands 306 and 308 to transmit communications using orthogonal frequency-division multiplexing (OFDM). For example, the uphole communication device 114*a* may decide how much data to send at frequencies in each of the pass bands 306 and 308 based on the indication of the pass bands 306 and 308 and the amplitudes of the pass bands 306 and 308 provided by the downhole communication device 114*b*. In other examples, the uphole communication device 114*a* may transmit the same message at frequencies from both of the pass bands 306 and 308 to provide signal redundancy.

Figure 4:
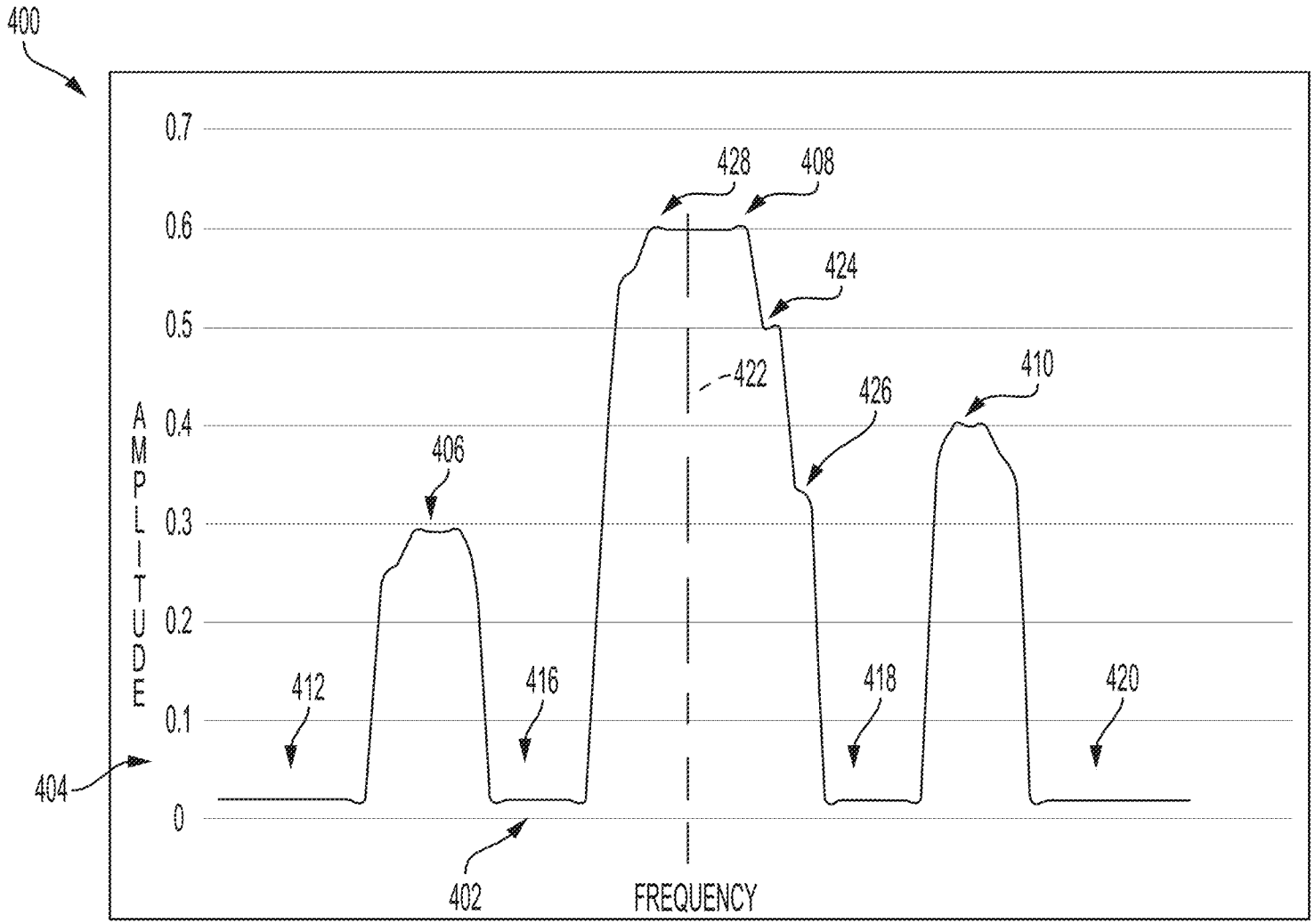
FIG. 4 is an example of a graph of spectrum data received at an uphole communication device according to some aspects.

FIG. 4 is an example of a graph 400 of spectrum data received at the uphole communication device 114*a* after the frequency 316 is selected at the downhole communication device 114*b*. An abscissa 402 represents a frequency range of the graph 300, and an ordinate 404 represents an amplitude of the received spectrum data. Upon determining the frequency 316, the downhole communication device 114*b* may send a test message 200 to the uphole communication device 114*a*. The test message 200 from the downhole communication device 114*b* may include an indication of the frequency 316 at which the downhole communication device 114*b* best receives messages from the uphole communication device 114*a* and the spectral waveform 206 that is flat across the frequency domain.

In an example, the uphole communication device 114*a* may receive the spectral waveform 206 from the downhole communication device 114*b* in response to the test message 200 originally sent from the uphole communication device 114*a* to the downhole communication device 114*b*. The spectral waveform 206 provided from the downhole communication device 114*b* to the uphole communication device 114*a* enables the uphole communication device 114*a* to determine an optimal frequency for the downhole communication device 114*b* to transmit messages to the uphole communication device 114*a*. The graph 400 depicts bands 406, 408, and 410 of the spectral waveform 206 that were received by the uphole communication device 114*a*. The graph 400 also depicts an amplitude of the spectral waveform 206 received at the bands 406, 408, and 410.

As illustrated, the uphole communication device 114*a* receives the spectral waveform 206 at bands 406, 408, and 410, but the received spectrum data outside of the bands 406, 408, and 410 approaches an amplitude of zero. The bands 406, 408, and 410 that enable receipt of the spectral waveform 206 may be a result of the wellbore conditions surrounding the uphole communication device 114*a*, the downhole communication device 114*b*, or a combination thereof. For example, the wellbore conditions may provide conditions that only pass certain signal frequency bands (e.g., the bands 406, 408, and 410) of signals while damping any remaining frequency bands (e.g., bands 412, 416, 418, and 420).

A processor that is connected to or otherwise in communication with the uphole communication device 114*a* may analyze the received spectrum data, as depicted in the graph 400, to determine an optimal acoustic channel for the downhole communication device 114*b* to transmit communication signals to the uphole communication device 114*a*. For example, while the uphole communication device 114*a* would receive signals at the frequencies represented by each of the bands 406, 408, and 410, the greater amplitude of the band 408 may represent improved signal quality in comparison to the bands 406 and 410. Further, the processor may select a frequency 422 at a midpoint of the band 408 to ensure that the signals transmitted from the downhole communication device 114*b* will have a frequency that falls within the band 408. In some examples, selection of the frequency 422 may also be associated with a frequency within a pass band with a greatest amplitude. For example, the amplitude of the band 408 may be tiered with portions 424 and 426 having a smaller amplitude than other portions of the band 408. In such an example, the processor may select a frequency value at a midpoint of a portion 428 with the greatest amplitude in the band 408. Any other techniques for selecting a suitable frequency within the pass band may also be used by the processor.

Further, the graph 400 depicts the three pass bands 406, 408, and 410 across which communication is possible from the downhole communication device 114*b* to the uphole communication device 114*a*. In one or more embodiments, the uphole communication device 114*a* may provide an indication to the downhole communication device 114*b* of the availability of all of the pass bands 406, 408, and 410, and the downhole communication device 114*b* may use frequencies from each or some of the pass bands 406, 408, and 410 to transmit communications using orthogonal frequency-division multiplexing (OFDM). For example, the downhole communication device 114*b* may decide how much data to send at frequencies in each or some of the pass bands 406, 408, and 410 based on the indication of the pass bands 406, 408, and 410 and the amplitudes of the pass bands 406, 408, and 410 provided by the uphole communication device 114*a*. In other examples, the downhole communication device 114*b* may transmit the same message at frequencies from each or some of the pass bands 406, 408, and 410 to provide signal redundancy.

Figure 5:
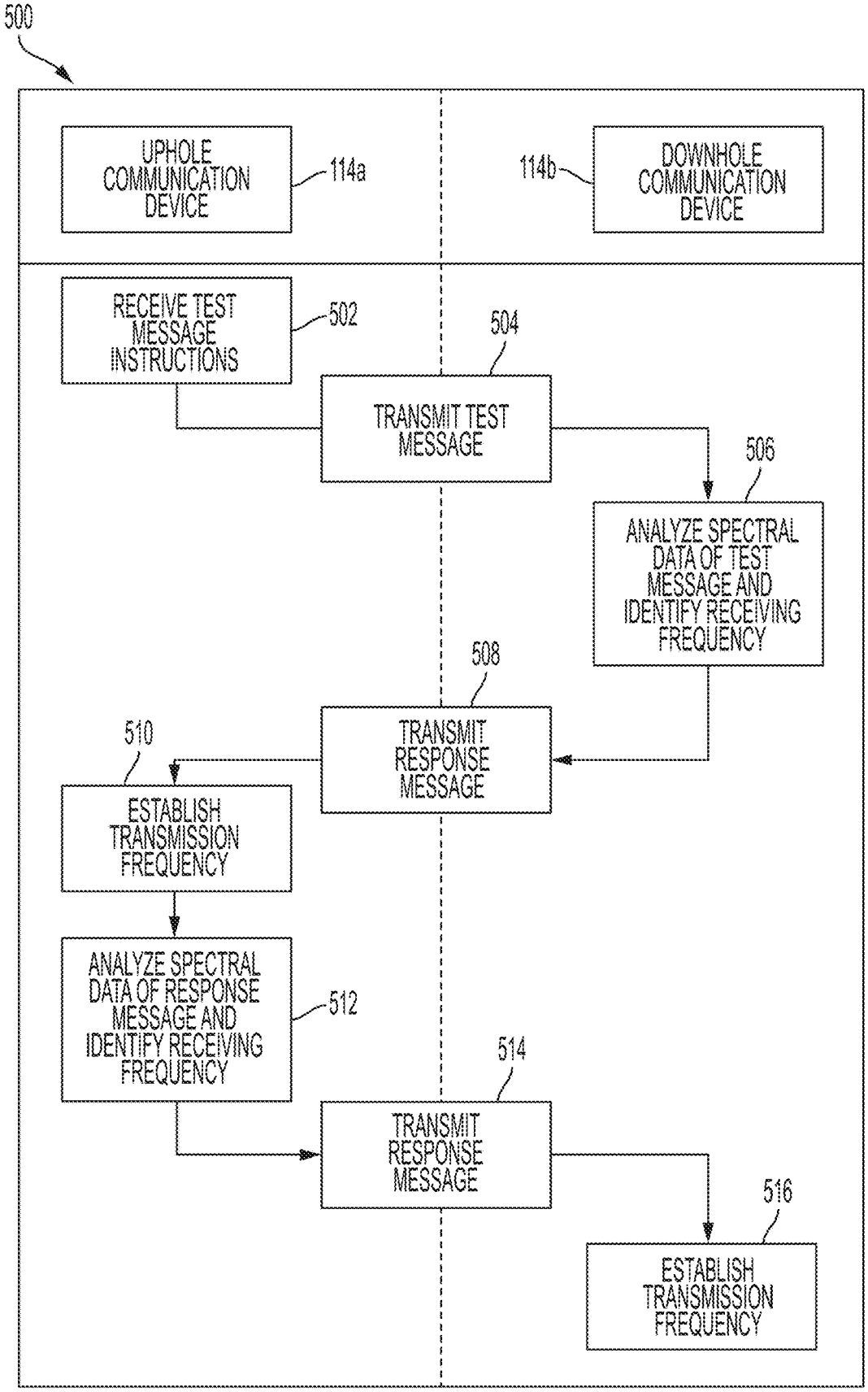
FIG. 5 is an example of data flow between an uphole communication device and a downhole communication device during a communication frequency selection process according to some aspects.

FIG. 5 is an example of data flow 500 between the uphole communication device 114*a* and the downhole communication device 114*b* during a communication frequency selection process. As discussed above, the uphole communication device 114*a* and the downhole communication device 114*b* may be transceivers, transmitters, receivers, or a combination of transmitters and receivers. The uphole communication device 114*a* and the downhole communication device 114*b* may communicate by transmitting acoustic signals along the tubing 106 within the wellbore 110 at frequencies selected for optimal acoustic transmission under wellbore conditions surrounding the communication devices 114*a* and 114*b*.

When the computing device 140*a-b* stops receiving messages from the downhole communication device 114*b*, the computing device 140*a-b* may initiate the communication frequency selection process for the downhole communication device 114*b*. Thus, at block 502, the process involves receiving test message instructions at the uphole communication device 114*a*. The test message instructions may be an indication to transmit the test message 200 to the downhole communication device 114*b*. In another example, the test message instructions may include the header 202 and the payload 204 of the test message 200 that are repeated through the other communication devices 114 until the header 202 and the payload 204 reach the uphole communication device 114*a*.

At block 504, the process involves transmitting the test message 200 to the downhole communication device 114*b*. The test message 200 may include the spectral waveform 206 including a range of frequencies (e.g., a range between 2 kHz and 3 kHz) with a flat amplitude across the frequency domain. Because the downhole communication device 114*b* may not be in communication with the uphole communication device 114*a* due to changing wellbore conditions around the communication devices 114*a* and 114*b*, the test message 200 may be transmitted at varying frequencies until the uphole communication device 114*a* receives a response from the downhole communication device 114*b*, as discussed below with respect to block 508.

When the downhole communication device 114*b* receives the test message 200 from the tubing 106 at block 506, the process involves analyzing the spectral data (e.g., from the spectral waveform 206) of the test message 200 and identifying a receiving frequency. As discussed above with respect to FIG. 3, a processor in communication with the downhole communication device 114*b* may analyze frequency bands from the spectral waveform 206 that were received by the downhole communication device 114*b*. The processor may determine the frequency 316 at which the downhole communication device 114*b* is most likely to receive a strongest signal from the uphole communication device 114*a*. For example, the processor may select the frequency 316 from a middle point of the frequency band with the greatest amplitude received at the downhole communication device 114*b*. Other selection techniques to select the frequency 316 from the frequency band with the greatest amplitude may also be used.

At block 508, the process involves transmitting a response message from the downhole communication device 114*b* to the uphole communication device 114*a*. In an example, the response message may be transmitted to the uphole communication device 114*a* at the same frequency that the downhole communication device 114*b* received the test message 200. The response message may serve multiple purposes. For example, the response message may provide an indication to the uphole communication device 114*a* that the test message 200 was received such that the uphole communication device 114*a* can stop sending the test message 200 at different frequencies. The response message may also include in indication of the frequency 316 at which the downhole communication device 114*b* best receives communications from the uphole communication device 114*a*. Additionally, the response message may include an additional spectral waveform 206 that is received at and analyzed by the uphole communication device 114*a* to determine the optimal communication frequency for the downhole communication device 114*b* to transmit messages to the uphole communication device 114*a*. In one or more examples, the response message may be repeated at varying frequencies until the downhole communication device 114*b* receives a separate response message from the uphole communication device 114*a* (e.g., at block 514) indicating that the response message from the downhole communication device 114*b* was received.

The response message may be in a format similar to the test message 200. For example, the response message may include the header 202 indicating that the message is a response message. Further, the response message may include the payload 204 indicating the frequency 316 requested for future communications from the uphole communication device 114*a* to the downhole communication device 114*b*. Additionally, the spectral waveform 206 may be appended to the header 202 and the payload 204.

At block 510, upon receipt of the response message at the uphole communication device 114*a*, the process involves establishing a transmission frequency for further communications with the downhole communication device 114*b*. In an example, the transmission frequency may be set to the frequency 316 identified by the downhole communication device 114*b* in the response message of block 508.

At block 512, the process involves analyzing the spectral data (e.g., from the spectral waveform 206) of the response message from the downhole communication device 114*b* and identifying a receiving frequency. As discussed above with respect to FIG. 4, a processor in communication with the uphole communication device 114*a* may analyze frequency bands from the spectral waveform 206 that were received by the uphole communication device 114*a*. The processor may determine the frequency 422 at which the uphole communication device 114*a* is most likely to receive a strongest signal from the downhole communication device 114*b*. For example, the processor may select the frequency 422 from a middle point of the frequency band with the greatest amplitude received at the uphole communication device 114*a*. Other selection techniques to select the frequency 422 from the frequency band with the greatest amplitude may also be used.

At block 514, the process involves transmitting a response message from the uphole communication device 114*a* to the downhole communication device 114*b*. In an example, the response message may be transmitted to the downhole communication device 114*b* at the frequency 316 established at block 510. The response message may serve multiple purposes. For example, the response message may provide an indication to the downhole communication device 114*b* that the response message transmitted at block 508 was received by the uphole communication device 114*a*. The response message may also include in indication of the frequency 422 at which the uphole communication device 114*a* best receives communications from the downhole communication device 114*b*.

In an example, the response message may be in a format similar to the test message 200 without the spectral waveform 206. For example, the response message may include the header 202 indicating that the message is a response message. Further, the response message may include the payload 204 indicating the frequency 422 requested for future communications from the downhole communication device 114*b* to the uphole communication device 114*a*.

At block 516, upon receipt of the response message at the downhole communication device 114*b*, the process involves establishing a transmission frequency for further communications with the uphole communication device 114*a*. In an example, the transmission frequency may be set to the frequency 422 identified by the uphole communication device 114*a* in the response message of block 514.

Figure 6:
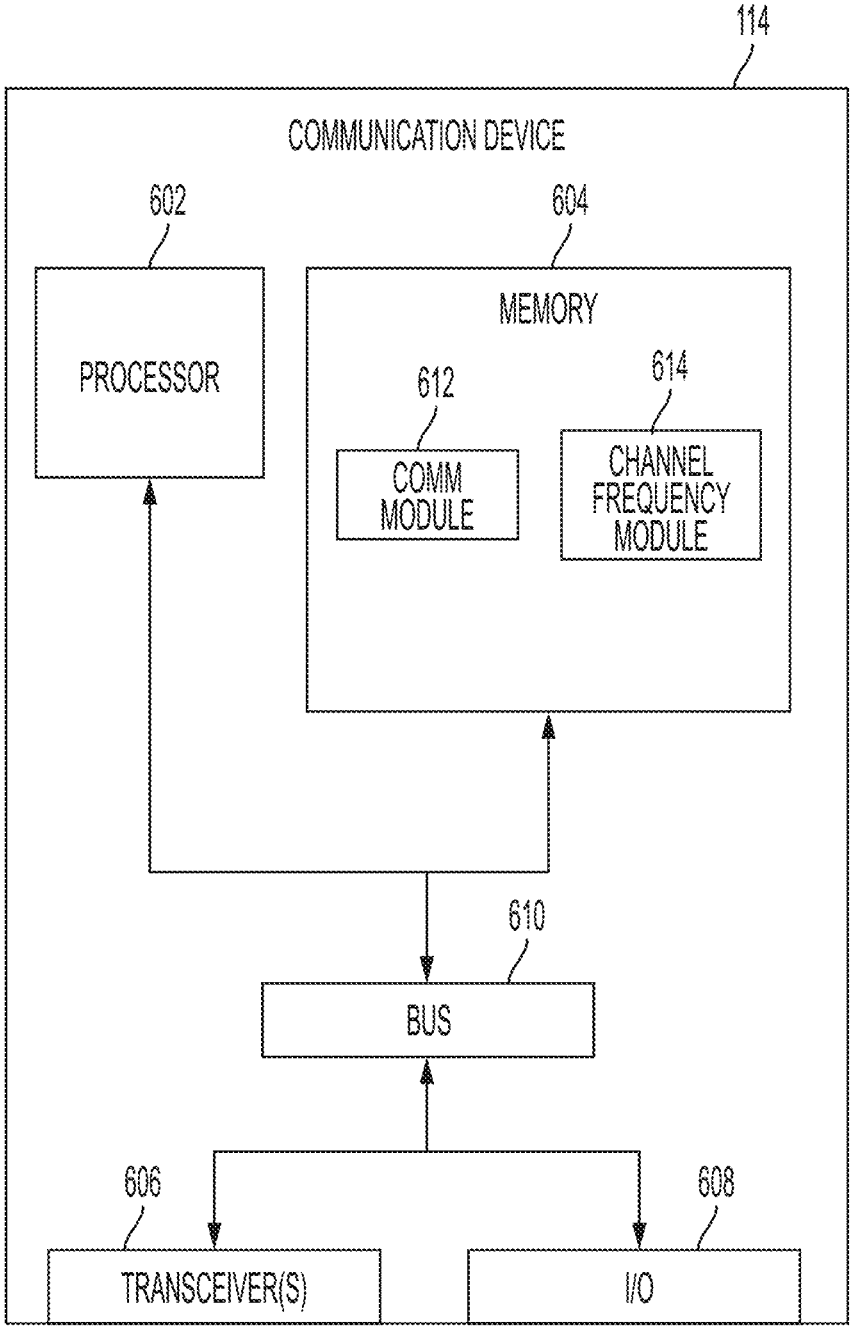
FIG. 6 is a block diagram of an example of a communication device that performs a communication frequency selection process according to some aspects.

Any suitable communication device 114 or group of communication devices 114 can be used for performing the operations described herein. For example, FIG. 6 depicts a block diagram of an example of the communication device 114 that performs a communication frequency selection process. In some embodiments, the communication device 114 may also communicate with downhole tools communicatively coupled to the communication device 114.

The depicted example of the communication device 114 includes a processor 602 communicatively coupled to one or more memory devices 604. The processor 602 executes computer-executable program code stored in a memory device 604, accesses information stored in the memory device 604, or both. Examples of the processor 602 include a microprocessor, an application-specific integrated circuit ("ASIC"), a field-programmable gate array ("FPGA"), or any other suitable processing device. The processor 602 can include any number of processing devices, including a single processing device.

The memory device 604 may include any suitable non-transitory computer-readable medium for storing data, program code, or both. A computer-readable medium can include any electronic, optical, magnetic, or other storage device capable of providing a processor with computer-readable instructions or other program code. Non-limiting examples of a computer-readable medium include a magnetic disk, a memory chip, a ROM, a RAM, an ASIC, optical storage, magnetic tape or other magnetic storage, or any other medium from which a processing device can read instructions. The instructions may include processor-specific instructions generated by a compiler or an interpreter from code written in any suitable computer-programming language, including, for example, C, C++, C#, Visual Basic, Java, Python, Perl, JavaScript, and ActionScript.

The communication device 114 may also include a number of external or internal devices, such as input or output devices. For example, the communication device 114 is shown with one or more transceivers 606. Further, the communication device 114 may include one or more input/output ("I/O") interfaces 608. The I/O interface 608 can receive input from input devices (e.g., downhole tools) or provide output to output devices (e.g., downhole tools). One or more buses 610 are also included in the communication device 114. The bus 610 communicatively couples one or more components of the communication device 114.

The communication device 114 executes program code that configures the processor 602 to perform one or more of the operations described herein. The program code includes, for example, a communication module 612, a channel frequency module 614, or other suitable applications that perform one or more operations described herein. The program code may be resident in the memory device 604 or any suitable computer-readable medium and may be executed by the processor 602 or any other suitable processor. For example, the communication module 612 may be used to configure the processor 602 to transmit or receive messages at the tubing 106 using the transceiver 606. In another example, the communication module 612 may be used to configure the processor 602 to transmit or receive messages to downhole tools connected to the communication device 114 at the I/O 608. In additional or alternative embodiments, the channel frequency module 614 may be used to configure the processor 602 to perform the communication frequency selection process, as described above with respect to FIG. 5. In additional or alternative embodiments, the program code described above is stored in one or more other memory devices accessible via a data network.

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

Unless specifically stated otherwise, it is appreciated that throughout this specification discussions utilizing terms such as "processing," "computing," "calculating," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

The system or systems discussed herein are not limited to any particular hardware architecture or configuration. A computing device can include any suitable arrangement of components that provide a result conditioned on one or more inputs. Suitable computing devices include multi-purpose microprocessor-based computer systems accessing stored software that programs or configures the computing system from a general purpose computing apparatus to a specialized computing apparatus implementing one or more embodiments of the present subject matter. Any suitable programming, scripting, or other type of language or combinations of languages may be used to implement the teachings contained herein in software to be used in programming or configuring a computing device.

Embodiments of the methods disclosed herein may be performed in the operation of such computing devices. The order of the blocks presented in the examples above can be varied—for example, blocks can be re-ordered, combined, or broken into sub-blocks. Certain blocks or processes can be performed in parallel.

The use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for purposes of example rather than limitation, and does not preclude the inclusion of such modifications, variations, and/or additions to the present subject matter as would be readily apparent to one of ordinary skill in the art.

In some aspects, systems, devices, and methods for determining downhole acoustic communication frequencies are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a tubing positionable within a wellbore; a first downhole communication device positionable to receive acoustic signals from the tubing and to transmit acoustic signals to the tubing; and a computing device in communication with the first downhole communication device, the computing device comprising: a processor; and a non-transitory computer-readable medium that includes instructions that are executable by the processor to perform operations comprising: receiving a test message comprising a spectral waveform from a second downhole communication device; determining a desired reception frequency for receiving communications from the second downhole communication device using spectral data generated from the spectral waveform; and controlling the first downhole communication device to transmit a response message to the second downhole communication device identifying the desired reception frequency.

Example 2 is the system of example 1, wherein the response message further comprises an additional spectral waveform usable by the second downhole communication device to identify a desired transmission frequency from the first downhole communication device.

Example 3 is the system of examples 1-2, wherein the first downhole communication device is controllable to transmit the response message at a same frequency as the test message.

Example 4 is the system of examples 1-3, wherein the operations further comprise: receiving an additional response message from the second downhole communication device identifying a desired transmission frequency for messages transmitted from the first downhole communication device to the second downhole communication device.

Example 5 is the system of examples 1-4, wherein the spectral waveform comprises an acoustic signal that is flat across a frequency domain.

Example 6 is the system of examples 1-5, wherein the first downhole communication device comprises a transceiver.

Example 7 is the system of examples 1-6, wherein the first downhole communication device is communicatively coupled to a downhole tool to provide a communication path between a surface of the wellbore and the downhole tool.

Example 8 is a method for adjusting communication frequencies, the method comprising: transmitting, by a first downhole communication device, a test message comprising a first spectral waveform along tubing within a wellbore to a second downhole communication device; receiving, at the first downhole communication device, a first response message comprising an indication of a desired transmission frequency to the second downhole communication device and a second spectral waveform from the second downhole communication device; determining a desired reception frequency for receiving communications from the second downhole communication device using spectral data generated from the second spectral waveform; and transmitting, by the first downhole communication device, a second response message to the second downhole communication device identifying the desired reception frequency.

Example 9 is the method of example 8, wherein the test message is retransmitted using different transmission frequencies until the first response message is received from the second downhole communication device.

Example 10 is the method of examples 8-9, wherein transmitting the second response message comprises transmitting the second response message at the desired transmission frequency.

Example 11 is the method of examples 8-10, wherein the first spectral waveform and the second spectral waveform are each flat across a frequency domain.

Example 12 is the method of examples 8-11, wherein determining the desired reception frequency comprises identifying a frequency within a pass band with a greatest amplitude of the spectral data.

Example 13 is the method of examples 8-12, wherein the first downhole communication device comprises a transceiver.

Example 14 is the method of examples 8-13, wherein the first downhole communication device is communicatively coupled to a downhole tool such that the first downhole communication device provides a communication path between a surface of the wellbore and the downhole tool.

Example 15 is the method of examples 8-14, wherein the first response message is received at the first downhole communication device from the tubing.

Example 16 is a downhole communication device, comprising: a transceiver positionable to receive first telemetry signals from downhole tubing and to transmit second telemetry signals to the downhole tubing; a processor in communication with the transceiver; and a non-transitory computer-readable medium that includes instructions that are executable by the processor to perform operations comprising: controlling the transceiver to transmit a test message comprising a first spectral waveform to an additional downhole communication device; receiving a first response message comprising an indication of a desired transmission frequency to the additional downhole communication device and a second spectral waveform from the additional downhole communication device; determining a desired reception frequency for receiving communications from the additional downhole communication device using spectral data generated from the second spectral waveform; and controlling the transceiver to transmit a second response message to the additional downhole communication device identifying the desired reception frequency.

Example 17 is the downhole communication device of example 16, wherein the operation of controlling the transceiver to transmit the second response message comprises controlling the transceiver to transmit the second response message at the desired transmission frequency.

Example 18 is the downhole communication device of examples 16-17, wherein the first spectral waveform and the second spectral waveform are each flat across a frequency domain.

Example 19 is the downhole communication device of examples 16-18, wherein the operation of determining the desired reception frequency comprises identifying a frequency within a pass band with a greatest amplitude of the spectral data.

Example 20 is the downhole communication device of examples 16-19, wherein the transceiver is adapted to retransmit the test message using different transmission frequencies until the first response message is received from the additional downhole communication device.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a tubing positionable within a wellbore;

a first downhole communication device positionable to receive acoustic signals from the tubing and to transmit acoustic signals to the tubing; and a computing device in communication with the first downhole communication device, the computing device comprising:

a processor; and a non-transitory computer-readable medium that includes instructions that are executable by the processor to perform operations comprising:

receiving a test message comprising a spectral waveform from a second downhole communication device;

determining a desired reception frequency for receiving communications from the second downhole communication device using spectral data generated from the spectral waveform by:

identifying one or more pass-bands through which the test message is received; and selecting the desired reception frequency from a particular pass-band of the one or more pass-bands using an algorithm that receives input comprising an area underneath each pass-band of the one or more pass-bands, amplitudes associated with the one or more pass-bands, a width of each pass-band of the one or more pass-bands, and a midpoint of the particular pass-band, wherein the particular pass-band has a highest amplitude, a highest width, or a highest area underneath the particular pass-band compared with other pass-bands of the one or more pass-bands; and controlling the first downhole communication device to transmit a response message to the second downhole communication device identifying the desired reception frequency.

2. The system of claim 1, wherein the response message further comprises an additional spectral waveform usable by the second downhole communication device to identify a desired transmission frequency from the first downhole communication device.

3. The system of claim 1, wherein the first downhole communication device is controllable to transmit the response message at a same frequency as the test message.

4. The system of claim 1, wherein the operations further comprise:

receiving an additional response message from the second downhole communication device identifying a desired transmission frequency for messages transmitted from the first downhole communication device to the second downhole communication device.

5. The system of claim 1, wherein the spectral waveform comprises an acoustic signal that is flat across a frequency domain.

6. The system of claim 1, wherein the first downhole communication device comprises a transceiver.

7. The system of claim 1, wherein the first downhole communication device is communicatively coupled to a downhole tool to provide a communication path between a surface of the wellbore and the downhole tool.

8. The system of claim 1, wherein the operation of selecting the desired reception frequency includes using an algorithm to select the desired reception frequency, wherein inputs to the algorithm include conditions in the wellbore and one or more signal-to-noise ratios associated with the one or more pass-bands, and wherein the conditions in the wellbore comprise a temperature of the wellbore, a pressure in the wellbore, or a flow of fluid in the wellbore.

9. A method for adjusting communication frequencies, the method comprising:

transmitting, by a first downhole communication device, a test message comprising a first spectral waveform along tubing within a wellbore to a second downhole communication device;

receiving, at the first downhole communication device, a first response message comprising an indication of a desired transmission frequency to the second downhole communication device and a second spectral waveform from the second downhole communication device;

determining a desired reception frequency for receiving communications from the second downhole communication device using spectral data generated from the second spectral waveform by:

identifying one or more pass-bands through which the test message is received; and selecting the desired reception frequency from a particular pass-band of the one or more pass-bands using an algorithm that receives input comprising an area underneath each pass-band of the one or more pass-bands, amplitudes associated with the one or more pass-bands, a width of each pass-band of the one or more pass-bands, and a midpoint of the particular pass-band, wherein the particular pass-band has a highest amplitude, a highest width, or a highest area underneath the particular pass-band compared with other pass-bands of the one or more pass-bands; and transmitting, by the first downhole communication device, a second response message to the second downhole communication device identifying the desired reception frequency.

10. The method of claim 9, wherein the test message is retransmitted using different transmission frequencies until the first response message is received from the second downhole communication device.

11. The method of claim 9, wherein transmitting the second response message comprises transmitting the second response message at the desired transmission frequency.

12. The method of claim 9, wherein the first spectral waveform and the second spectral waveform are each flat across a frequency domain.

13. The method of claim 9, wherein the first downhole communication device comprises a transceiver.

14. The method of claim 9, wherein the first downhole communication device is communicatively coupled to a downhole tool such that the first downhole communication device provides a communication path between a surface of the wellbore and the downhole tool.

15. The method of claim 9, wherein the first response message is received at the first downhole communication device from the tubing.

16. A downhole communication device, comprising:

a transceiver positionable to receive first telemetry signals from downhole tubing and to transmit second telemetry signals to the downhole tubing;

a processor in communication with the transceiver; and a non-transitory computer-readable medium that includes instructions that are executable by the processor to perform operations comprising:

controlling the transceiver to transmit a test message comprising a first spectral waveform to an additional downhole communication device;

receiving a first response message comprising an indication of a desired transmission frequency to the additional downhole communication device and a second spectral waveform from the additional downhole communication device;

determining a desired reception frequency for receiving communications from the additional downhole communication device using spectral data generated from the second spectral waveform by:

identifying one or more pass-bands through which the test message is received; and selecting the desired reception frequency from a particular pass-band of the one or more pass-bands using an algorithm that receives input comprising an area underneath each pass-band of the one or more pass-bands, amplitudes associated with the one or more pass-bands, a width of each pass-band of the one or more pass-bands, and a midpoint of the particular pass-band, wherein the particular pass-band has a highest amplitude, a highest width, or a highest area underneath the particular pass-band compared with other pass-bands of the one or more pass-bands; and controlling the transceiver to transmit a second response message to the additional downhole communication device identifying the desired reception frequency.

17. The downhole communication device of claim 16, wherein the operation of controlling the transceiver to transmit the second response message comprises controlling the transceiver to transmit the second response message at the desired transmission frequency.

18. The downhole communication device of claim 16, wherein the first spectral waveform and the second spectral waveform are each flat across a frequency domain.

19. The downhole communication device of claim 16, wherein the operation of determining the desired reception frequency comprises identifying a frequency within a pass band with a greatest amplitude of the spectral data.

20. The downhole communication device of claim 16, wherein the transceiver is adapted to retransmit the test message using different transmission frequencies until the first response message is received from the additional downhole communication device.

* * * * *